United States Patent [19]

Robinson

[11] 4,180,264

[45] Dec. 25, 1979

[54] RACKET HANDLE AND METHOD OF MAKING SAME

[75] Inventor: Mark L. Robinson, Andover, Mass.

[73] Assignee: Acro, Inc., Stoneham, Mass.

[21] Appl. No.: 790,552

[22] Filed: Apr. 25, 1977

[51] Int. Cl.[2] ..... A63B 49/08

[52] U.S. Cl. ..... 273/73 J; 264/46.6

[58] Field of Search ..... 273/72 R, 73 R, 73 J, 273/73 F, 73 H, 75, 81 R, 82 R; 145/61 R; 74/551.9; 264/45.2, 45.5, 46.4, 46.5, 46.6

[56] References Cited

U.S. PATENT DOCUMENTS

| | | | |
|---|---|---|---|
| 1,536,288 | 5/1925 | Freedlander et al. | 273/73 J X |
| 1,768,933 | 7/1930 | Riley | 273/81 R X |
| 1,813,797 | 7/1931 | Foley | 145/61 C X |
| 2,976,577 | 3/1961 | Gould | 264/46.6 |
| 3,582,073 | 6/1971 | Melnick et al. | 273/73 J |
| 3,606,326 | 9/1971 | Sparks et al. | 273/75 X |
| 3,702,701 | 11/1972 | Vaughn et al. | 273/73 J X |
| 3,716,433 | 2/1973 | Plummer | 273/81 R X |
| 3,795,722 | 3/1974 | Sassaman | 273/82 R X |
| 3,949,988 | 4/1976 | Staufer | 273/73 F |

FOREIGN PATENT DOCUMENTS

| | | | |
|---|---|---|---|
| 1463358 | 12/1966 | France | 264/46.6 |

*Primary Examiner*—Richard J. Apley
*Attorney, Agent, or Firm*—Charles Hieken

[57] ABSTRACT

A grip is placed inside a mold and the grip and mold are filled with a foam material. The handle pieces of a metal sport racket are placed inside the grip, so that as the foam rises and hardens, the foam becomes a handle around the handle pieces with the grip covering the handle.

7 Claims, 6 Drawing Figures

RACKET HANDLE AND METHOD OF MAKING SAME

BACKGROUND OF THE INVENTION

The present invention relates in general to game racket handles and more particularly concerns a novel molded plastic game racket handle and method of its construction characterized by an excellent bond of the grip to the handle established while the handle is being molded in a time-saving process.

Molded plastic handles for game rackets are generally known to the art. The handle sections of the racket frame are placed in a mold, which is then filled with a plastic material which forms the racket handle when hardened. The handle is then wrapped with a strip of material, usually leather or rubber, to form a grip around the handle.

A disadvantage with this method is that two steps are requuired: (1) molding the handle and (2) wrapping the grip about it. Another disadvantage is that the grip is glued to the handle, which creates a less than permanent bond. The glues may also be hazardous in their uncured state.

With the molding process, there is the disadvantage that a mold release material is required between the mold and the molded plastic handle. Futhermore, the demolding time and the mold heat control are somewhat critical in the formation of an adequate handle.

It is an important object of this invention to provide an improved game racket handle with a grip and method of its manufacture which overcomes one or more of the disadvantages enumerated above.

It is another object of the invention to achieve the preceding object with a more permanent bond between the handle and the grip without the use of glue.

It is a further object of the invention to achieve one or more of the preceding objects with a method that does not require mold release.

It is still a further object of the invention to achieve one or more of the preceding objects with a method that has less critical time and heat requirements.

SUMMARY OF THE INVENTION

According to the invention, a mold is made to the shape and size of the desired racket handle. A premolded elastomeric grip is inserted in the mold. The grip is filled with expandable foam and the handle sections of the racket are inserted into the foam-filled grip. As the form expands, it generates pressure against the rubber grip and stretches the rubber into the desired handle shape as defined by the shape of the mold. When hardened, the completed grip and handle assembly is released from the mold.

Numerous other features, objects, and advantages of the invention will become apparent from the following specification when read in connection with the accompanying drawing in which:

DETAILED DESCRIPTION OF PREFERRED EMBODIMENTS

Figure 1:
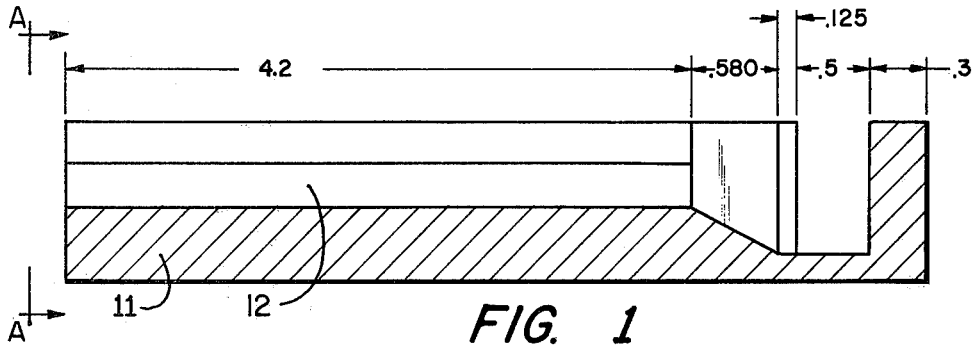
FIG. 1 is a longitudinal sectional view of one-half of the mold for the racket handle.
Figure 2:
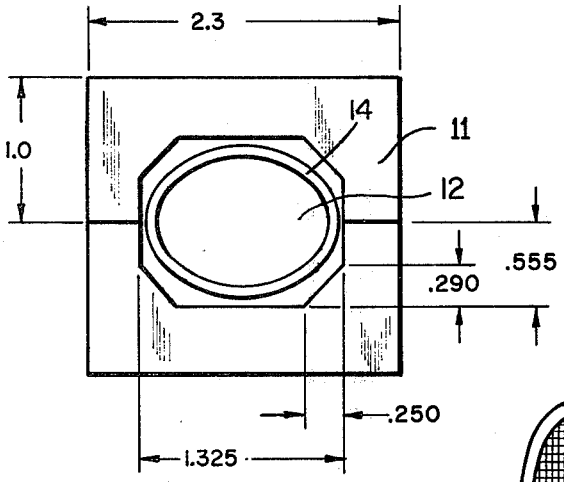
FIG. 2 is an end view of the mold in the direction indicated by line A—A in FIG. 1.

With reference now to the drawing and more particularly FIG. 1 thereof, there is shown a longitudinal sectional view of one-half of the mold for constructing a racket handle according to the invention. A mold 11 is constructed with a cavity 12 in the shape and size of the desired racket handle. The mold 11 may be made of aluminum. FIG. 2 shows an end view from line A—A of FIG. 1, illustrating the octagonal cross section of the cavity 12 conforming to the shape of the racket handle with stretchable grip 14 prior to expansion seated therein.

Figure 3:
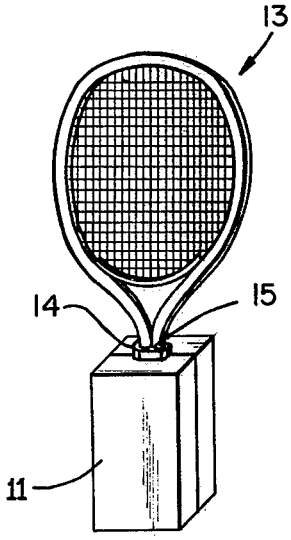
FIG. 3 is a perspective view of a game racket with the handle extremities seated in the mold.

Referring to FIG. 3, there is shown a racket 13 with handle sections seated in cavity 12 of mold 11. A premolded seamless elastomeric grip 14, such as the "tennis pride" made by Eaton Rubber, is inserted into cavity 12. The cavity 12 is then filled with a rigid or semirigid expandable foam-in-place plastic such as General Latex 16 L 110, so that the foam is inside the grip 14. The handle sections of racket 13 are inserted into the foam-filled grip. A projection 15 on the handle sections, defining the top of the handle, forms a seal between the grip 14 and the handle sections, preventing the foam from escaping.

As the foam expands, it exerts pressure against the rubber grip 14 and stretches the rubber into the desired handle shape having flat intersecting surfaces as defined by the shape of the cavity 12. When the foam has hardened, the completed grip and handle assembly is removed from the mold 11. There is no need for mold release because no material is added between the grip and the mold 11. The demolding time and the heat control are less critical than in the conventional process.

It is also within the principles of the invention to use other specific grip materials, plastics and specific molding processes provided that the plastic material on solidifying firmly fills and engages the grip. In the specific example the racket handles are inserted into the foam-in-place plastic within minutes after the plastic enters cavity 12 and remains in place for minutes until the foam-in-place plastic has set.

Cavity 12 may be shaped to account for the way the rubber grip 14 fills the mold to produce sharper corners in the handle.

Figure 4:
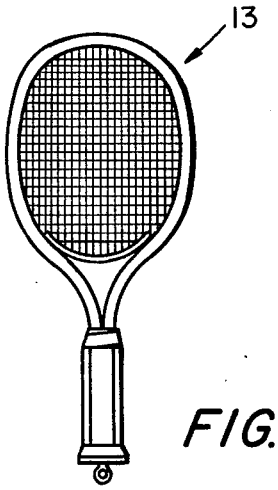
FIG. 4 is a perspective view of a game racket having a handle with grip bonded thereto according to the invention.

Referring to FIG. 4 there is shown a perspective view of a racket 13 with a handle and grip according to the invention.

Figure 5:
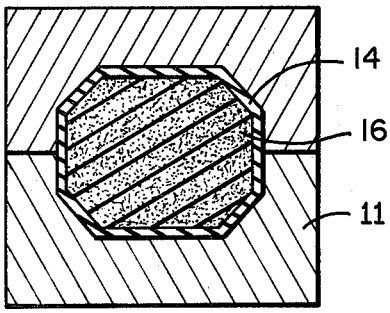
FIG. 5 is a plan diagram of a mold with sharp corners illustrating how the rubber tends to form corners that are rounded.

Referring to FIG. 5, there is shown a plan diagrammatic view of mold 11, rubber 14 and foam 16 illustrating how the thickness of the rubber and its natural tendency to recover from a deformed shape when forced into a corner and then removed from the mold tends to result in the corner of the finished handle being slightly rounded. Further, the lower pressures developed with some self-blowing foams may result in incompletely filling the corners.

Figure 6:
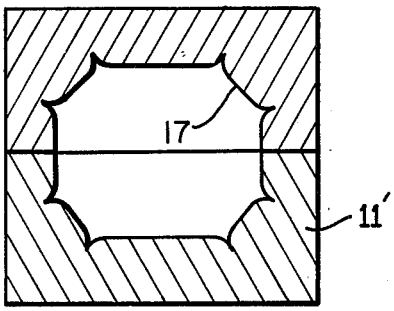
FIG. 6 is a plan view of a preferred mold showing an exaggerated view of corner modifications to accentuate corners so that the resultant handle has sharp corners.

Referring to FIG. 6, there is shown a plan view of mold 11' modified to overcome the problem described above showing an exaggerated view of corner modification to illustrate how the inside surfaces such as 17 of mold 11' are slightly concave. The preferred shape leading into each corner is a radius and/or series of radii because they are easy to generate in practice. However, the ideal curve may be some conic section or polynomial curve which is what the radius or series of radii are approximating. The radius of curvature leading into the corners is inversely proportional to the pressure of the foam and directly proportional to rubber thickness, other factors are modulus of elasticity durometer and other parameters related to the degree with which the rubber tends to return to its unstretched condition. The actual curvature is preferably determined by empirical methods.

There has been described a novel method for constructing a molded plastic handle for a metal sport racket. Numerous other departures from and modifications of the specific embodiments described herein may now be practiced by those skilled in the art without departing from the inventive concepts. Consequently, the invention is to be construed as embracing each and every novel feature and novel combination of features present in or possessed by the method herein disclosed and limited solely by the spirit and scope of the appended claims.

What is claimed is:

1. A method of making handles for game rackets comprising, inserting a stretchable handle grip covering into a cavity of a mold corresponding substantially to the size and shape of the desired handle, filling said covering inside said cavity with expandable plastic material, inserting the handle extremity of the racket into said covering, causing said plastic material to expand and stretch the covering to the shape of the mold, allowing the plastic to harden into a handle around said handle extremity bonded to and covered by said covering with the hardened plastic filling all the region between the handle extremity and the surrounding covering which covering forms the outer surface of said handle, and disengaging said mold from said handle and grip covering assembly.

2. A method of making handles for game rackets in accordance with claim 1 wherein said expandable plastic material is foam-in-place plastic material.

3. A method of making handles for game rackets in accordance with claim 1 and further including the step of confining said plastic material substantially to the volume inside said covering with a cap attached to the end of the handle extremity adjacent to the racket throat.

4. A game racket having a plastic handle covered by a stretchable hand grip covering made according to the method of claim 1.

5. In a game racket having a frame, a plastic handle having flat intersecting surfaces and finished shape conforming to that of a mold in which the handle was molded and made of foam-in-place plastic bonded to a stretchable grip surrounding the hardened expanded foam-in-place plastic and bonded thereto by the expanding and hardening of said foam-in-place plastic, said stretchable grip prior to expansion of said foam-in-place plastic having a shape different from said finished shape and after expansion corresponding substantially to said finished shape and being the outer surface of said handle, the extremeties of said frame being seated in said foam-in-place plastic which plastic fills essentially the entire region between said extremeties and said stretchable grip.

6. A game racket plastic handle in accordance with claim 5 wherein said stretchable grip is seamless.

7. A game racket plastic handle in accordance with claim 6 having sharp corners between adjacent intersecting surfaces.

* * * * *